US006639991B2

(12) United States Patent
Lehdorfer

(10) Patent No.: US 6,639,991 B2
(45) Date of Patent: Oct. 28, 2003

(54) ELECTROACOUSTIC TRANSDUCER

(75) Inventor: Hannes Lehdorfer, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 246 days.

(21) Appl. No.: 09/836,887

(22) Filed: Apr. 17, 2001

(65) Prior Publication Data

US 2002/0027998 A1 Mar. 7, 2002

(30) Foreign Application Priority Data

Apr. 17, 2000 (AT) ..... 675/2000

(51) Int. Cl.[7] ..... H04R 25/00
(52) U.S. Cl. ..... 381/386; 381/398
(58) Field of Search ..... 381/412, 397, 381/420, 433, 400, 430, 386, FOR 159, FOR 161, 398, 89, 395; 379/433.02; 181/199, 150

(56) References Cited

U.S. PATENT DOCUMENTS 5,157,731 A * 10/1992 Mitobe ..... 381/420
5,682,435 A * 10/1997 De Wit et al. ..... 381/386
5,699,438 A * 12/1997 Smith et al. ..... 381/386

* cited by examiner

*Primary Examiner*—Curtis Kuntz
*Assistant Examiner*—Tuan D. Nguyen
(74) *Attorney, Agent, or Firm*—Friedrich Kueffner

(57) ABSTRACT

An electroacoustic transducer, functioning as an acoustic pick-up or as a sound generator, has a housing having a bottom and a wall portion. A diaphragm is connected to the housing opposite the bottom and encloses a diaphragm volume. An electromagnetic system is arranged in the housing and has a coil connected to the diaphragm. The housing has at least one cutout cooperating with at least one projection provided on a device in which the electroacoustic transducer is to be mounted. The projection defines a passage between the diaphragm volume and a volume at the back of the housing and thus forms the main air passage.

4 Claims, 2 Drawing Sheets

ELECTROACOUSTIC TRANSDUCER

BACKGROUND OF THE INVENTION

1. Field of the Invention

The invention relates to an electroacoustic transducer which functions either as a sound generator or acoustic pick-up and also relates, in particular, to the mounting of such an acoustic transducer in a device, for example, a mobile telephone, a head set, a console of a computer screen and the like.

2. Description of the Related Art

An important component of each electroacoustic transducer is the so-called main friction path, an air passage which connects the volume underneath the diaphragm, i.e., the volume between the diaphragm and the closest bottom-side component, with the ambient volume behind the transducer. Depending on the desired application of the electroacoustic transducer, in particular, depending on the geometric situation and the employed materials of the device in which the transducer is to be mounted, it is required to configure this air passage differently in comparison to other mounting situations which, based on a first impression, actually appear to be similar.

The necessity of adapting the main friction path to the mounting situation requires that substantially constructively identical electroacoustic transducers are to be provided with different main friction paths and these are then to be listed and stocked as different replacement parts etc. This means that at the latest with the assembly of such a transducer component which defines the main friction path, even for large production series the identity is lost and all the problems caused by components of relatively small production series will be encountered.

SUMMARY OF THE INVENTION

It is an object of the present invention to find a solution which makes it possible to adapt the main friction path of an electroacoustic transducer to the specific requirements of the device only at the time of mounting the transducer in the device so that up to the point of assembly all electroacoustic transducers of a series are of identical configuration so that the production, storage, and repair are significantly simplified.

In accordance with the present invention, this is achieved in that the bottom and/or wall portion of the electroacoustic transducer has at least one cutout and that in the device to be furnished with the transducer projections are provided which, when mounting the transducer, form the passage between the diaphragm volume and the volume at the back and thus form the desired main friction path.

This solution according to the invention makes it indeed possible to mount one and the same electroacoustic transducer in different devices because the projections provided on the devices will reduce or completely close the air passages provided within the electroacoustic transducer between the diaphragm volume and the volume at the back in such a way that the desired main friction path results.

DESCRIPTION OF THE PREFERRED EMBODIMENTS

Figure 1:
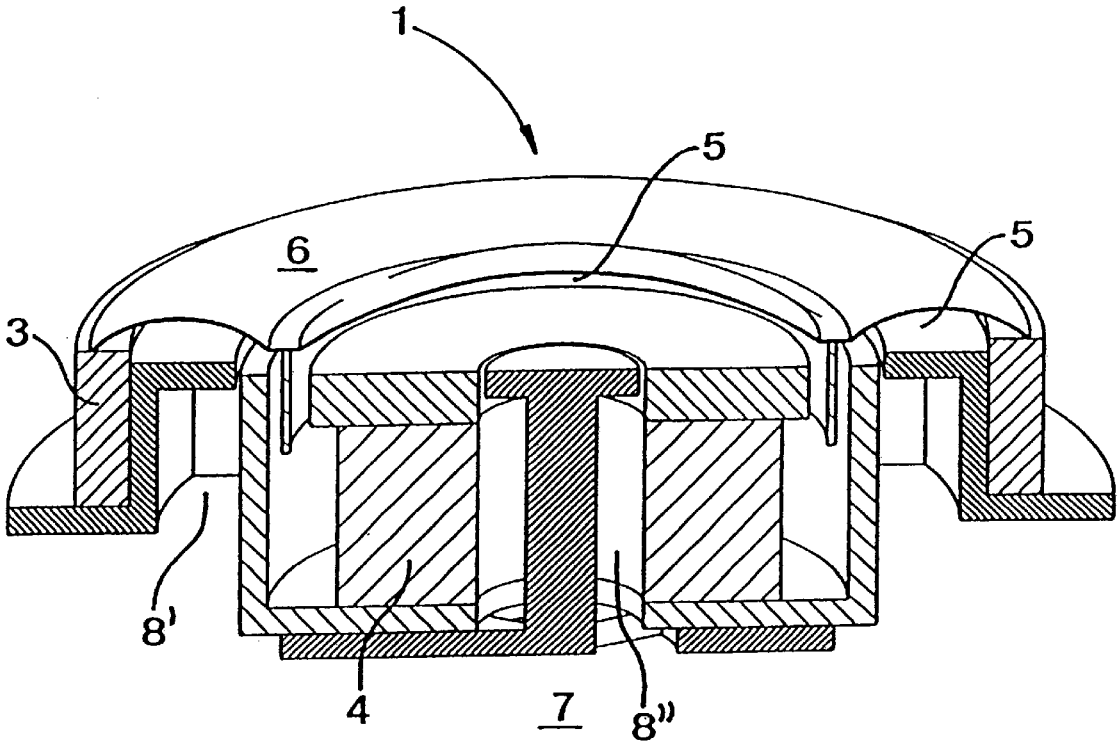
FIG. 1 is a perspective view of the electroacoustic transducer (and also shown in section) according to the present invention.
Figure 2:
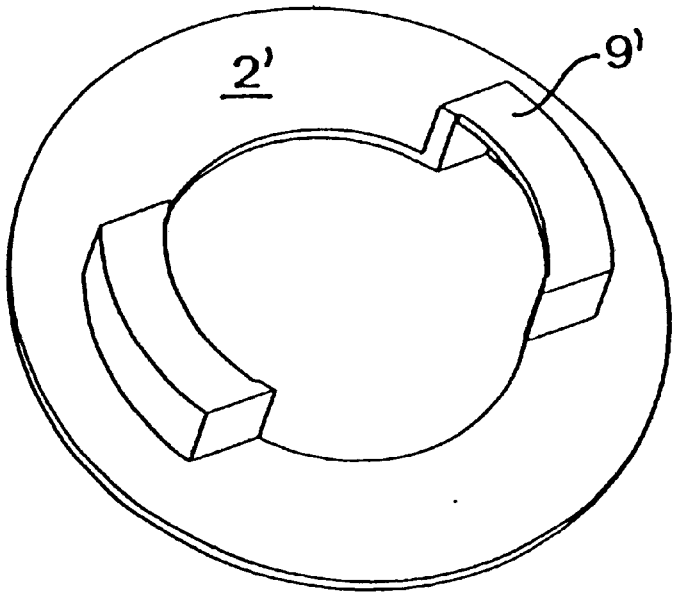
FIGS. 2 and 3 are persepective views of device parts having projections for receiving the electroacoustic transducer.
Figure 3:
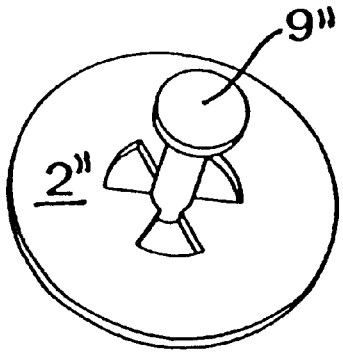

As can be seen in FIG. 1, the electroacoustic transducer, which is identified by reference numeral 1, is to be mounted on the parts 2' and 2" of a device (not shown). The transducer 1 is comprised substantially of a housing 3 and, in the illustrated electroacoustic transducer, of a magnetic system 4. Between the yoke edges of the magnetic system 4 a circular gap is provided in which a coil can vibrate in the axial direction. The coil is fastened on the diaphragm 6, usually by gluing. Between the magnetic system 4 and the diaphragm 6, a diaphragm volume 5 is defined which is changed by the movement of the diaphragm.

The characteristics of the electroacoustic transducer depend substantially on how this diaphragm volume 5 communicates with the volume 7 at the back. In the illustrated embodiment the connection between the diaphragm volume 5 and the volume 7 at the back cavity is defined by a substantially annular gap 8' and a central opening 8". When the parts 2' and 2" provided on the device receive the transducer 1, these connections between the diaphragm volume 5 and the volume 7 at the back are reduced by the projections 9' and the stamp-like projection 9" to the desired size.

The central part 2" can be a separately manufactured part which is fastened during, or shortly before, mounting of the transducer 1 in the device on the transducer, for example, by gluing. However, it is, of course, also possible that the corresponding mounting location in the device is configured such that the part 2" is connected with the part 2' by stays or similar means and thus forms a part of a wall or partition of the device in which the transducer 1 is to be mounted.

With the injection molding technology for plastic materials known in the art, it is no problem to maintain required tolerances, and the projections 9' can therefore also take over the task of properly positioning the transducer 1 and to facilitate and improve its proper contacting by securing the position of the contacts (not illustrated) of the electroacoustic transducer 1.

The above explanations, in particular, in connection with the disclosure of the drawing, illustrate that the configuration of the annular gap 8' or of the central opening 8" or openings (not illustrated) in the mantle walls of the transducer can be combined and adapted in many ways. It is important that the main friction path by which the diaphragm volume is connected to the volume of the back cavity is defined by housing parts or by housing parts in cooperation with transducer parts. With a corresponding configuration of the transducer and an correspondingly adapted configuration of the mounting location in the respective device, it is possible to provide a practically universally usable transducer whose specific adaptation to the device in which it is to be used is provided by the device itself.

In the illustrated embodiments, the device parts which support the projections 9' and 9" are shown as separate structural components. This is not necessarily required: these projections can be integral parts of the housing of the device into which the transducer is to be inserted and which is usually manufactured of plastic material. When the transducer is not directly mounted on the housing, it is, of course, possible to provide these projections on any other device part, or separate structural components are indeed used in this situation.

While specific embodiments of the invention have been shown and described in detail to illustrate the inventive principles, it will be understood that the invention may be embodied otherwise without departing from such principles.

What is claimed is:

1. An electroacoustic transducer functioning as an acoustic pick-up or as a sound generator, the electroacoustic transducer comprising:

a housing having a bottom and a wall portion;

a diaphragm connected to the housing opposite the bottom and enclosing a diaphragm volume;

an electromagnetic system arranged in the housing and comprising a coil connected to the diaphragm;

the housing having at least one cutout configured to cooperate with at least one projection provided on a device in which the electroacoustic transducer is to be mounted;

wherein the at least one projection is configured to define a passage between the diaphragm volume and a volume at the back of the housing and thus forms the main air passage.

2. The electroacoustic transducer according to claim 1, wherein the cutout is an annular gap.

3. The electroacoustic transducer according to claim 1, wherein the cutout is a central opening.

4. The electroacoustic transducer according to claim 1, wherein the at least one projection is arranged on a separate structural component connected to the device.

* * * * *